United States Patent [19]

Zarich

[11] 4,436,015

[45] Mar. 13, 1984

[54] STRINGED INSTRUMENT BRIDGE

[76] Inventor: Milan S. Zarich, 801 Dodd Rd., West St. Paul, Minn. 55118

[21] Appl. No.: 420,123

[22] Filed: Sep. 20, 1982

[51] Int. Cl.[3] ..... G10D 3/04

[52] U.S. Cl. ..... 84/298; 84/307

[58] Field of Search ..... 84/267, 298, 299, 307

[56] References Cited

U.S. PATENT DOCUMENTS

| | | | |
|---|---|---|---|
| 860,137 | 7/1907 | Inskeep | 84/267 |
| 2,031,706 | 2/1936 | Hambrecht et al. | 84/299 X |
| 2,074,982 | 3/1937 | Di Marzio | 84/307 |
| 2,214,957 | 9/1940 | Furgiuele | 84/314 N |
| 2,491,991 | 12/1949 | Lundback | 84/307 |
| 3,353,433 | 11/1967 | Webster | 84/307 X |

FOREIGN PATENT DOCUMENTS

| | | | |
|---|---|---|---|
| 8166 | of 1906 | United Kingdom | 84/267 |

*Primary Examiner*—Lawrence R. Franklin

*Attorney, Agent, or Firm*—Terryl K. Qualey

[57] ABSTRACT

A bridge for a stringed instrument has a base plate, an elongate end wall extending perpendicularly from the base plate and having a plurality of laterally spaced string grooves, and an elongate bridge bar parallel to the end wall and having string support grooves across the surface that faces the base plate corresponding to the string support grooves across the end wall. The bridge bar is movable toward and away from the base plate while maintaining the spacing between the bridge bar string support grooves and the base plate less than the spacing between the end wall string support grooves and the base plate.

4 Claims, 5 Drawing Figures

STRINGED INSTRUMENT BRIDGE

1. Field of the Invention

The present invention relates to a bridge for a stringed instrument.

2. Background of the Invention

Most stringed musical instruments have a bridge over which the strings pass that holds the strings away from the body of the instrument as illustrated in U.S. Pat. Nos. 496,706; 677,395; 835,085; 897,964; and 1,170,999. Many of such instruments, particularly the less expensive instruments, are difficult to play because the bridge holds the strings too far from the finger board and too much pressure is required to press the strings against the finger board in playing the instrument. Moreover, the tension in the strings passing over the bridge acts as a force tending to pull the head of the instrument toward the bridge and any warpage in the finger board or neck of the instrument tends to relieve this force thereby further increasing the space between the strings and the finger board; again making the instrument more difficult to play. Other bridges having holes through which the strings pass, as illustrated in U.S. Pat. Nos. 2,031,706 and 2,074,982, have the same problems.

SUMMARY OF THE INVENTION

The present invention provides a bridge for a stringed instrument having a base plate, an elongate end wall extending perpendicularly from the base plate, an elongate bridge bar supported spaced from and parallel to the end wall and means for moving the bridge bar toward and away from the base plate. The elongate end wall has a plurality of laterally spaced string grooves extending across the end wall spaced from the base plate and the bridge bar has corresponding string support grooves across its surface that faces the base plate. Means for moving the bridge bar toward and away from the base plate maintains the spacing between the bridge bar string support grooves and the base plate less than the spacing between the end wall string support grooves and the base plate.

The bridge of the present invention is attached by its base plate to the body of a stringed musical instrument. The strings extend from the head of the stringed instrument across the finger board and a portion of the body, across the string support grooves under the bridge bar and then away from the body to the string grooves in the end wall. The bridge bar may be moved toward the base plate and thus toward the body of the instrument to move the strings closer to the finger board, thereby to make playing of the instrument easier both upon installation of the bridge and later should warpage occur.

THE DRAWING

DESCRIPTION OF THE PREFERRED EMBODIMENT

Figure 1:
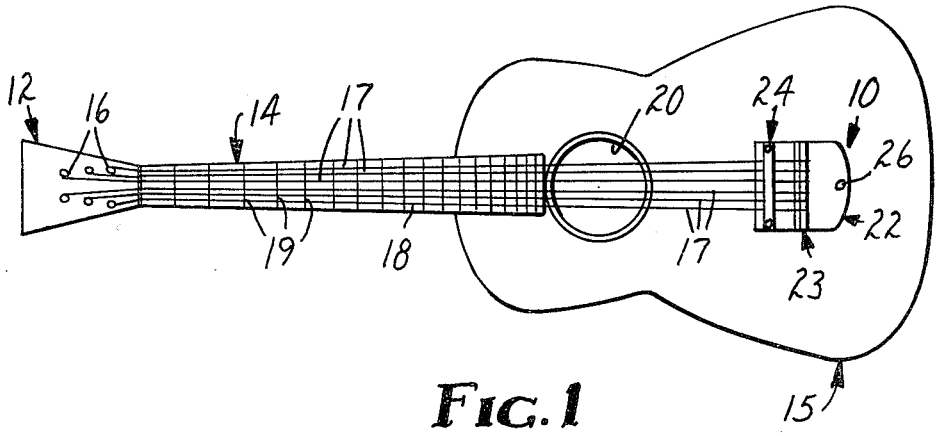
FIG. 1 is a top view of a guitar utilizing a stringed instrument bridge constructed in accordance with the present invention.
Figure 2:
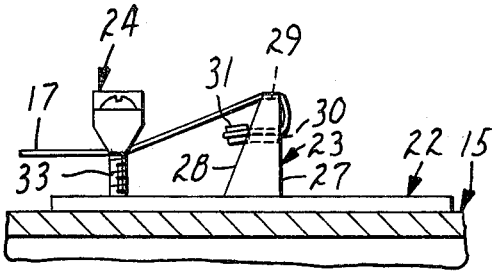
FIG. 2 is a side elevation view of the bridge and surrounding portion of the guitar body.
Figure 3:
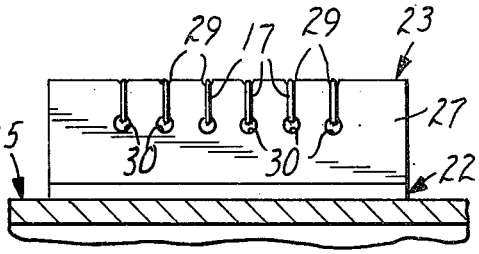
FIG. 3 is an elevation view of the bridge and the surrounding portion of the guitar body from the right side of the bridge as illustrated in FIGS. 1 and 2.
Figure 5:
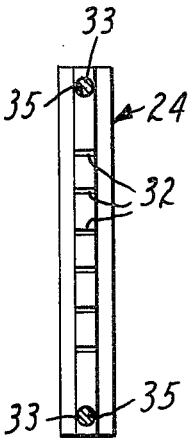
FIG. 5 is a bottom view of the bridge bar seen in elevation in FIG. 4.
Figure 4:
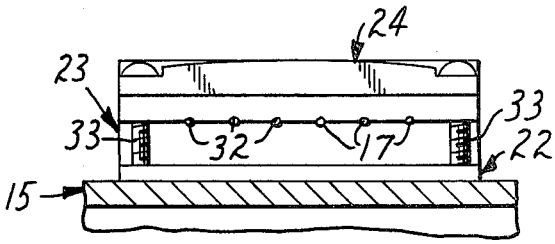
FIG. 4 is an elevation view of the bridge and surrounding portions of the guitar body from the left side of the bridge as illustrated in FIGS. 1 and 2.

The illustrated embodiment of the bridge 10 of the present invention is constructed for use on a conventional guitar having a head 12, a neck 14 and a body 15. The guitar has tuning pins 16 in the head 12 retaining one end of each string 17, a finger board 18 with spaced parallel frets 19 down the neck 14 and onto the body 15 and a sound hole 20 in the body 15. The bridge 10 comprises a base plate 22, an elongate end wall 23 extending perpendicularly from the base plate, an elongate bridge bar 24 supported spaced from and parallel to the end wall and means for moving the bridge bar toward and away from the base plate.

In the illustrated embodiment the base plate 22 is a flat aluminum plate and it is fastened to the upper surface of the guitar body 15 by a single screw 26. The end wall 23 is also aluminum and it is secured to the base plate 22 by two machine screws (not shown) extending through apertures in the base plate and threaded into the base of the end wall 23. The end wall 23 is trapezoidal in end view with its rear surface 27 perpendicular to the base plate 22 and its forward surface 28 inclined at an acute angle to the base to aid in withstanding the forces applied by the strings 17. The upper surface of the end wall 23 is formed with six equally spaced string grooves 29. In the illustrated embodiment an aperture 30 is made through the end wall 23 below each string groove 29. The strings 17 are run across the string grooves, down the rear surface 27 of the end wall and through the apertures 30, and metal caps 31 are crimped onto the ends of the strings 17 adjacent the forward surface 28 of the end wall to positively retain them on the end wall.

The bridge bar 24 has string support grooves 32 across its surface that faces the base plate 22 which correspond to the string support grooves 29 across the end wall 23. It is supported on a pair of posts 33 extending perpendicularly from the base plate 22, the support posts being spaced equidistant from the end wall 23 and also equidistant from the center line of the string path defined by the bridge bar string support grooves 32.

Means for moving the bridge bar 24 toward and away from the base plate maintains the spacing between the bridge bar string support grooves 32 and the base plate 22 less than the spacing between the end wall string support grooves 29 and the base plate 22. In the illustrated embodiment the means for moving the bridge bar comprises the support posts 33 being threaded machine screws, extending through apertures 35 in the bridge bar 24 that are larger in diameter than the support posts. The machine screws 33 have their heads above the bridge bar 24 and are threaded into apertures extending through the base plate 22.

The illustrated guitar bridge 10 can be included as part of a new guitar or may be supplied as a replacement bridge. In many instances it may be utilized as illustrated without any tail piece to connect the strings to the end of the guitar body 15 furthest from the head 12. However, it may also be used with a tail piece either in a new construction or as a replacement by simply continuing the strings through the end wall string grooves 29 to a tail piece connected to the end of the guitar body 15. If a tail piece is used it will, of course, require less to secure the base plate 22 to the guitar body 15 since the tension in the strings will not be pulling on the bridge 10.

In use, the strings 17 extend from the tuning pins 16 across the finger board 18 and the sound hole 20, under the bridge bar 24 and then away from the base plate 22 (and thus away from the guitar body 15) across the end wall string grooves 29 and through the apertures 30 where the metal caps 31 at the ends of the strings are retained. The adjustment screws 33 are turned down into the base plate 22 in conjunction with the tightening of the strings by the tuning pins 16 to position the strings for the closest and most comfortable distance between the strings 17 and the finger board 18. If, after a period of time, the finger board and/or neck does warp causing a greater spacing between the strings and the finger board 18, the adjustment screws 33 may be turned down further to again provide the proper spacing between the strings and the finger board.

I claim:

1. A bridge for a stringed instrument comprising:

a base plate, an elongate end wall extending perpendicularly from said base plate and having a plurality of laterally spaced string grooves extending across said end wall spaced from said base plate, an elongate bridge bar supported spaced from and parallel to said end wall and having string support grooves across its surface that faces said base plate corresponding to said string support grooves across said end wall, and means for moving said bridge bar toward and away from said base plate while maintaining the spacing between said bridge bar string support grooves and said base plate less than the spacing between said end wall string support grooves and said base plate.

2. The stringed instrument bridge of claim 1 wherein said bridge bar is supported on a pair of posts extending perpendicularly from said base plate, said support posts being spaced equidistant from said end wall and equidistant from the center line of the string path defined by said bridge bar string support grooves.

3. The stringed instrument bridge of claim 2 wherein said support posts are machine screws that extend through apertures in said bridge bar and are threaded into said base plate.

4. The stringed instrument bridge of claim 1, 2 or 3 wherein an aperture is formed through said end wall between each said string groove and said base plate through which the ends of the strings may pass to be retained on said end wall by metal end caps crimped onto the ends of strings.

* * * * *